US010490920B2

(12) United States Patent
Manickam

(10) Patent No.: US 10,490,920 B2
(45) Date of Patent: Nov. 26, 2019

(54) CARD EDGE CONNECTOR

(71) Applicant: Molex, LLC, Lisle, IL (US)

(72) Inventor: Venkatesan Manickam, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/220,092

(22) Filed: Dec. 14, 2018

(65) Prior Publication Data

US 2019/0214755 A1 Jul. 11, 2019

(30) Foreign Application Priority Data

Dec. 14, 2017 (CN) ..... 2017 1 1339370

(51) Int. Cl.
*H01R 12/72* (2011.01)
*H01R 13/648* (2006.01)

(52) U.S. Cl.
CPC ..... *H01R 12/721* (2013.01); *H01R 13/648* (2013.01)

(58) Field of Classification Search
CPC ..... H01R 12/721; H01R 13/648
USPC ..... 439/59
See application file for complete search history.

(56) References Cited

U.S. PATENT DOCUMENTS

| | | | |
|---|---|---|---|
| 6,019,616 | A | 2/2000 | Yagi et al. |
| 6,739,884 | B2 | 5/2004 | Vicich et al. |
| 7,114,963 | B2 | 10/2006 | Shuey et al. |
| 7,731,541 | B1 | 6/2010 | Lee et al. |
| 9,166,317 | B2 | 10/2015 | Briant et al. |
| 9,455,530 | B2 | 9/2016 | Patel |

*Primary Examiner* — Alexander Gilman
(74) *Attorney, Agent, or Firm* — Molex, LLC

(57) ABSTRACT

A card edge connector comprises an insulative housing and at least one terminal module. The insulative housing has an elongated shape and is formed with a card edge slot and a terminal retention base mounting groove communicating with the card edge slot. The terminal module comprises a terminal retention base mounted in the terminal retention base mounting groove and at least one row of conductive terminals which are fixed to the terminal retention base side by side, the plurality of the conductive terminals comprises ground terminals, each conductive terminal has a fixed portion fixed to the terminal retainer and an elastic arm portion extending from the fixed portion into the card edge slot. The terminal module further comprises a common grounding shield, the common grounding shield comprises a sheet provided on the terminal retainer and a plurality of grounding elastic arms extending from the sheet.

11 Claims, 16 Drawing Sheets

CARD EDGE CONNECTOR

FIELD OF THE PRESENT DISCLOSURE

The present disclosure relates to a connector, and particularly to a card edge connector.

BACKGROUND OF THE PRESENT DISCLOSURE

Generally, when an electrical connector is used to transmit high-frequency signals, the crosstalk is easy to occur between terminals of the electrical connector, the crosstalk refers to the inductance coupling and the capacitance coupling between the two signal lines due to the close space distance, thereby interfering with each other, and such an interference will affect the transmission of the signals.

Chinese Patent Application CN200620003253.5 (corresponding to U.S. Pat. No. 7,114,963, hereinafter referred to as prior art 1) discloses an electrical connector which has a contact retention module in which a plurality of contacts (terminals) are embedded and an outer shell used to fix the contact retention module. Chinese Patent Application CN201510196516.2 (corresponding to U.S. Pat. No. 9,166,317, hereinafter referred to as prior art 2) discloses a high speed electrical connector which discloses a technique that uses a housing having a datum surface and a crush rib to secure a contact assembly. However, the above prior art 1 and the prior art 2 do not disclose a technique that uses a metal ground element to enhance the grounding characteristics so as to enhance the grounding characteristics of the high-frequency signals. Chinese Patent Application CN96180150.6 (corresponding to U.S. Pat. No. 6,019,616, hereinafter referred to as prior art 3) discloses a configuration in which a metal grounding shield covers an outer casing of the connector and has a grounding lead to pass through an aperture to elastically contact with an intermediate section of the connector terminal, but the intermediate section of the connector terminal in the prior art 3 is fixed and stationary, the connection between a free end of the grounding lead and the intermediate section of the connector terminal relies solely on the elastic force of the grounding lead, if the grounding lead is elastically fatigued or deformed so as to cause poor contact, the effect of the grounding shield is lowered, and in some configurations, a stronger and more comprehensive grounding shield is required to improve the transmission speed of the high-frequency signals.

SUMMARY OF THE PRESENT DISCLOSURE

Therefore, an object of the present disclosure is to provide a card edge connector which can effectively improve the crosstalk.

Therefore, in some embodiments, a card edge connector of the present disclosure comprises an insulative housing and at least one terminal module. The insulative housing has an elongated shape extending along a length direction, the insulative housing comprises a mating surface and a mounting surface on opposite sides, a card edge slot open to the mating surface and a terminal retention base mounting groove open to the mounting surface and communicating with the card edge slot, the insulative housing further comprises two side walls extending along the length direction to together define the card edge slot and the terminal retention base mounting groove. The at least one terminal module comprises a terminal retention base extending along the length direction and mounted in the terminal retention base mounting groove and at least one row of conductive terminals which are spaced apart from each other and fixed to the terminal retention base side by side along the length direction, the plurality of the conductive terminals comprises signal terminals and ground terminals, each conductive terminal has a fixed portion fixed in the terminal retention base, an elastic arm portion extending upwardly from the fixed portion to the card edge slot, a contact portion extending from a distal end of the elastic arm portion into the card edge slot and a tail portion extending out of the mounting surface of the insulative housing from the fixed portion. Wherein, the terminal module further comprises at least one common grounding shield, the common grounding shield comprises a sheet extending along the length direction and provided between the terminal retention base and the side wall of the insulative housing and a plurality of the grounding elastic arms extending from the sheet toward the mating surface and respectively corresponding to the plurality of ground terminals in position, each grounding elastic arm has an elastic portion extending upwardly from the sheet and an abutting portion extending upwardly from the elastic portion, the abutting portion elastically abuts against a facing outer side surface of the elastic arm portion of the corresponding ground terminal facing the corresponding side wall.

In some embodiments, the terminal module comprises two rows of conductive terminals which face each other and are fixed in the terminal retention base and two common grounding shields, the sheets of the common grounding shields are respectively provided between the terminal retention base and the corresponding side walls of the insulative housing.

In some embodiments, the terminal retention base has two terminal retainers which are united with each other and mounted in the terminal retention base mounting groove, the two rows of conductive terminals are respectively fixed in the terminal retainers, the common grounding shields are respectively provided on the corresponding terminal retainers and each are respectively positioned between the corresponding terminal retainer and the side wall of the insulative housing.

In some embodiments, each row of the conductive terminals is composed of a plurality of signal terminal pairs and a plurality of ground terminals, the plurality of the signal terminal pairs are alternated with the plurality of ground terminals.

In some embodiments, the terminal retention base has an installation surface to allow the sheet of the common grounding shield to be provided thereon and a first positioning structure formed on the installation surface, the sheet of each common grounding shield is formed with a second positioning structure engaged with the first positioning structure to be relatively fixed with the terminal retention base.

In some embodiments, the first positioning structure comprises at least one positioning protruding block, the second positioning structure comprises at least one positioning hole which is engaged with the positioning protruding block.

In some embodiments, the first positioning structure comprises a positioning protruding bar which is formed at a top of the installation surface of the terminal retention base and extends along the length direction, the second positioning structure comprises a positioning surface positioned at a top of the sheet and engaged with the positioning protruding bar, the terminal retention base is further formed with a plurality of recessed channels which respectively allow the plurality of the grounding elastic arms to pass through at the positioning protruding bar.

In some embodiments, the first positioning structure further comprises at least one latching block formed on the mounting surface, the second positioning structure further comprises at least one cutout engaged with the at least one latching block, the insulative housing has at least one latching hole formed at an inner wall surface defining the terminal retention base mounting groove and latching with the at least one latching block of the terminal retention base.

In some embodiments, the insulative housing is further formed with a plurality of protruding ribs protruding from an inner wall surface defining the terminal retention base mounting groove, the plurality of protruding ribs are used to forcibly abut against the terminal retention base of the at least one terminal module and the at least one common grounding shield.

In some embodiments, the insulative housing comprises a plurality of partition ribs positioned in the card edge slot adjacent to the terminal retention base mounting groove and spaced apart from each other and arranged side by side along the length direction.

In some embodiments, the insulative housing is further formed with a plurality of terminal receiving grooves which respectively receive the plurality of conductive terminals and a plurality of the grounding elastic arm receiving grooves which respectively receive the plurality of the grounding elastic arms at an inner wall surface defining the card edge slot.

The present disclosure has the following beneficial effects: by that the common grounding shield abuts against and connects to the plurality of ground terminals, it strengthens the grounding characteristic to create the shielding effect between the signal terminals, and, by that each grounding elastic arm of the common grounding shield elastically abuts against the facing outer side surface of the elastic arm portion of the corresponding ground terminal, the normal contact force between the ground terminal and the mating object and the contact force between the ground terminal and the grounding elastic arm can be increased when the mating object is inserted into the card edge connector, in turn, the ground terminals, the grounding elastic arms and the mating object can contact can contact reliably and firmly to ensure that the shielding effect of the common grounding shield can be continuously maintained in a stable state, thereby improving the crosstalk.

BRIEF DESCRIPTION OF THE FIGURES

Other features and effects of the present disclosure will be apparent from the embodiments with reference to figures, in which.

REFERENCE NUMERALS IN FIGURES ARE REPRESENTED AS FOLLOWS

Figure 1:
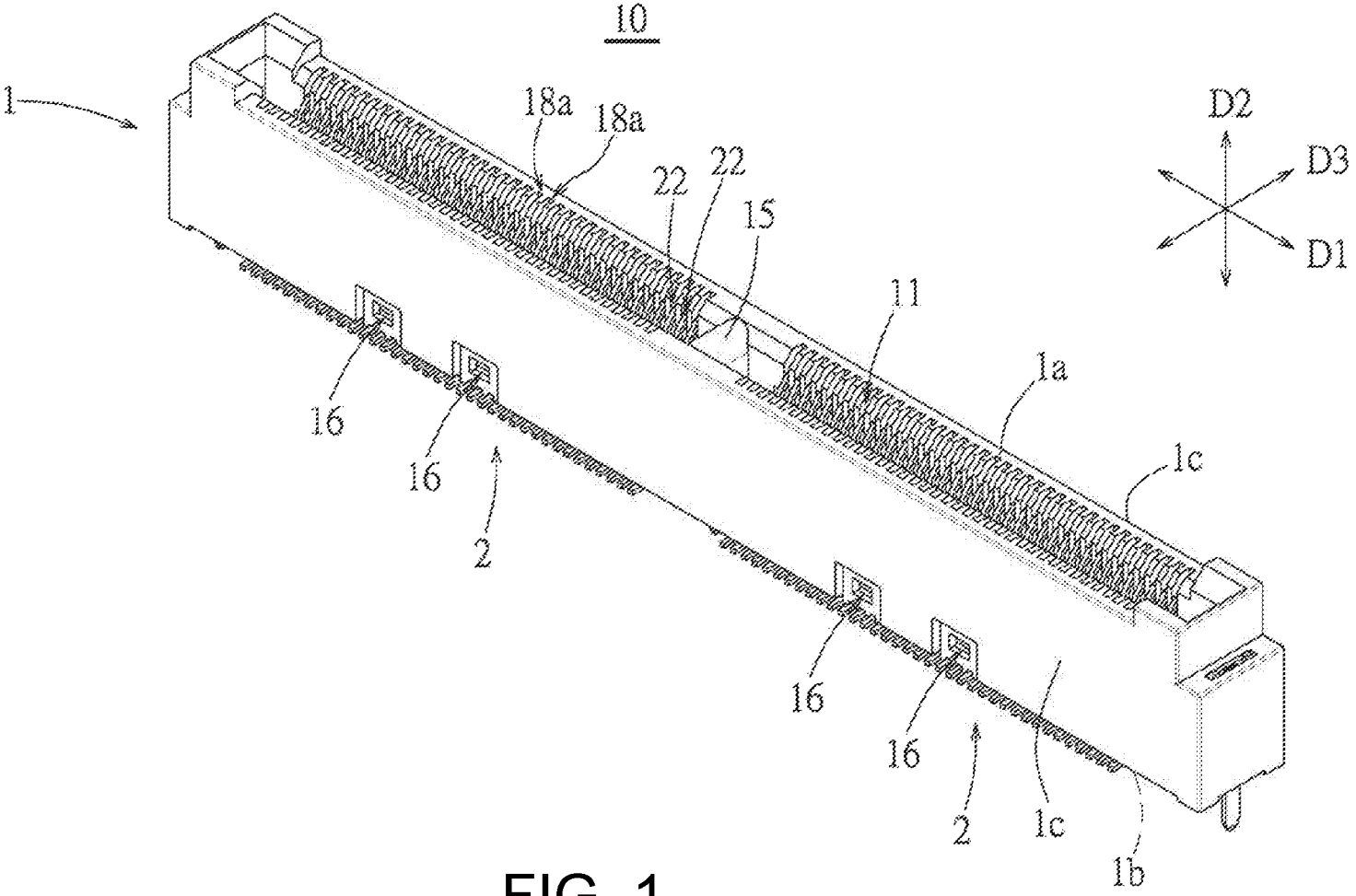
FIG. 1 is a perspective view of an embodiment of a card edge connector of the present disclosure.
Figure 2:
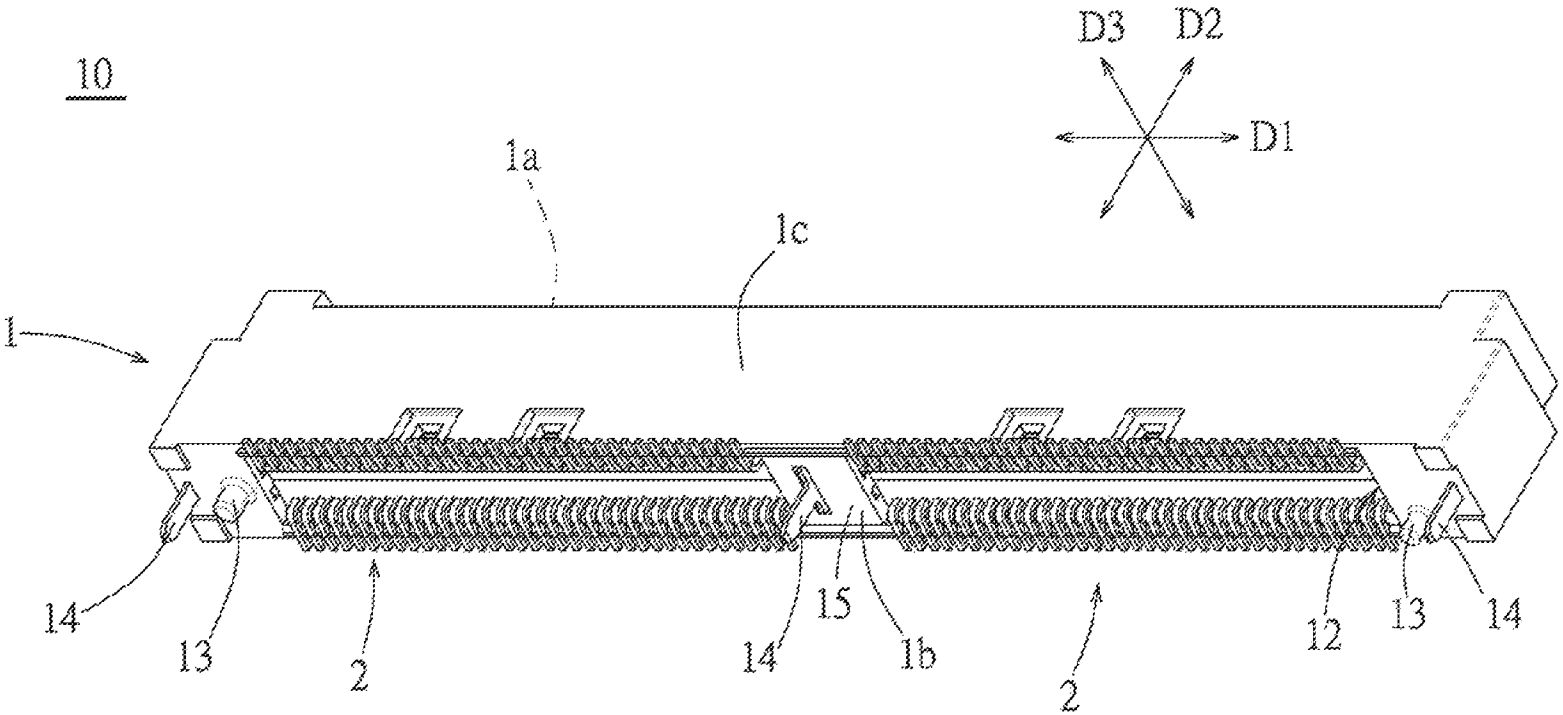
FIG. 2 is a perspective view viewed differently from FIG. 1.

10 card edge connector
1 insulative housing
1*a* mating surface
1*b* mounting surface
1*c* side wall
11 card edge slot
12 terminal retention base mounting groove
13 board positioning post
14 board fixing element
15 positioning partition portion
16 latching hole
17 protruding rib
18*a* terminal receiving groove
18*b* grounding elastic arm receiving groove
19 partition rib
2 terminal module
20 terminal retention base
21 terminal retainer
210 installation surface
211 latching block
212 first positioning structure
212*a* positioning protruding block
212*b* positioning protruding bar
213 recessed channel
22 conductive terminal
221 signal terminal
222 ground terminal
223 fixed portion
224 elastic arm portion
225 contact portion
226 tail portion
3 common grounding shield
31 sheet
311 second positioning structure
311*a* positioning hole
311*b* positioning surface
311*c* cutout
32 grounding elastic arm
321 elastic portion
322 abutting portion
D1 length direction
D2 up-down direction
D3 width direction

DETAILED DESCRIPTION

Referring to FIG. 1 to FIG. 4, an embodiment of a card edge connector 10 of the present disclosure is illustrated, the embodiment is adapted to be mounted on a circuit board (not shown in drawing) and allow a mating object (not shown in the figures) to insert in, so as to electrically connect the mating object and the circuit board, in the embodiment, the mating object is an electronic card, such as a memory card, a graphics card and the like. The card edge connector 10 comprises an insulative housing 1 and at least one terminal module 2; it should be noted that the embodiment comprises two sets of terminal modules 2, in other embodiments, the number of terminal modules 2 may vary, and is not limited thereto.

The insulative housing 1 has an elongated shape extending along a length direction D1, the insulative housing 1 comprises a mating surface 1*a* and a mounting surface 1*b* on opposite sides, a card edge slot 11 open to the mating surface 1*a* and used for insertion of the mating object and a terminal retention base mounting groove 12 open to the mounting surface 1*b* and communicating with the card edge slot 11, the insulative housing 1 further comprises two side walls 1*c* extending along the length direction D1 to together define the card edge slot 11 and the terminal retention base mounting groove 12. In the embodiment, the mating surface 1*a* and the mounting surface 1*b* are opposite each other in an up-down direction D2 perpendicular to the length direction D1, in addition, in the embodiment, the insulative housing 1 further comprises board positioning posts 13 which are positioned at the mounting surface 1*b* and used to insert into positioning holes (not shown in the figures) of the circuit board to position the card edge connector 10 and a plurality of board fixing elements 14 which are used to insert into and be soldered to a plurality of fixing holes (not shown in the figures) of the circuit board to fix the card edge connector 10 on the circuit board, but the insulative housing 1 is not limited thereto.

Figure 5:
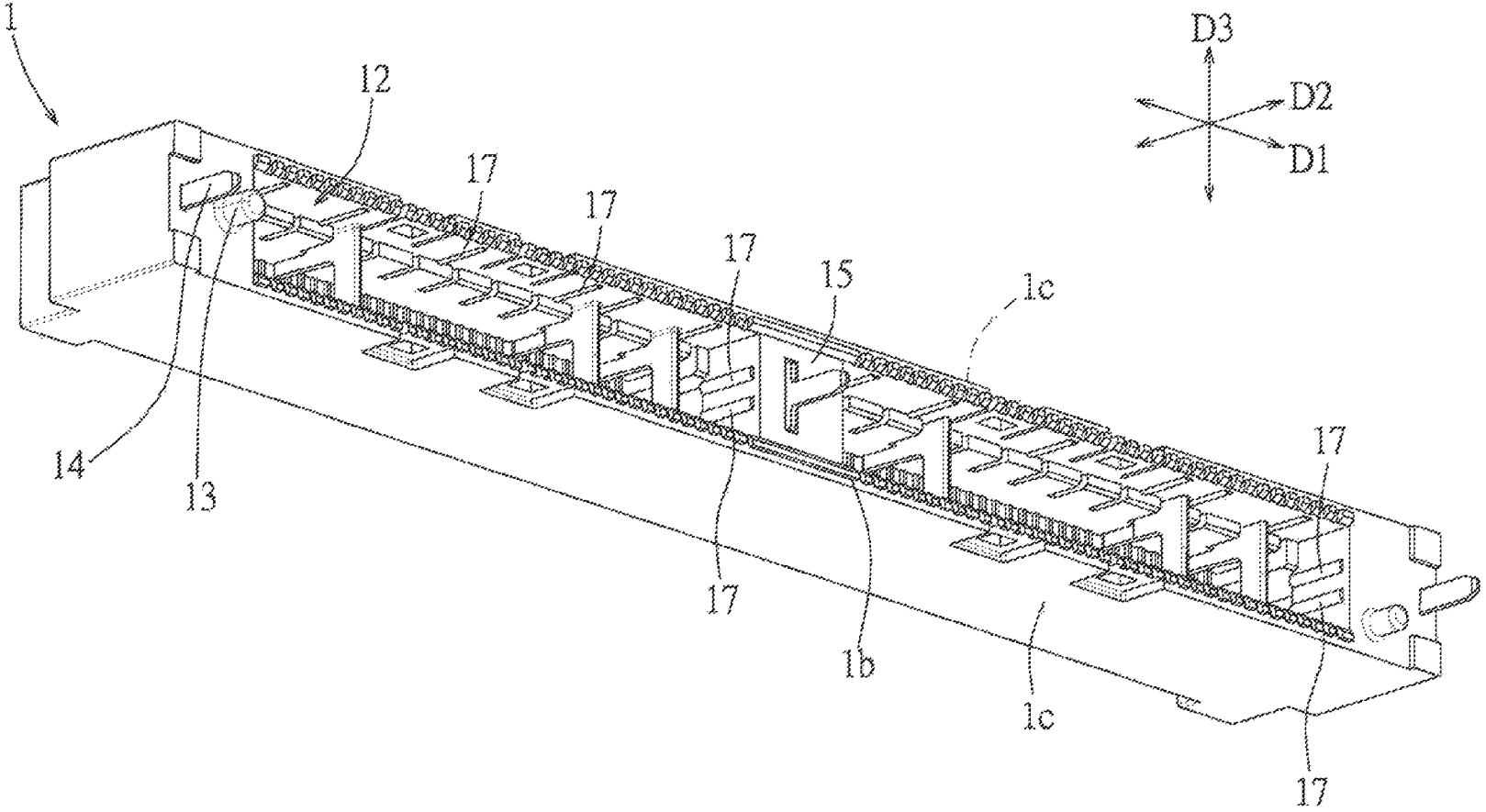
FIG. 5 is a perspective view illustrating an insulative housing of the embodiment.
Figure 6:
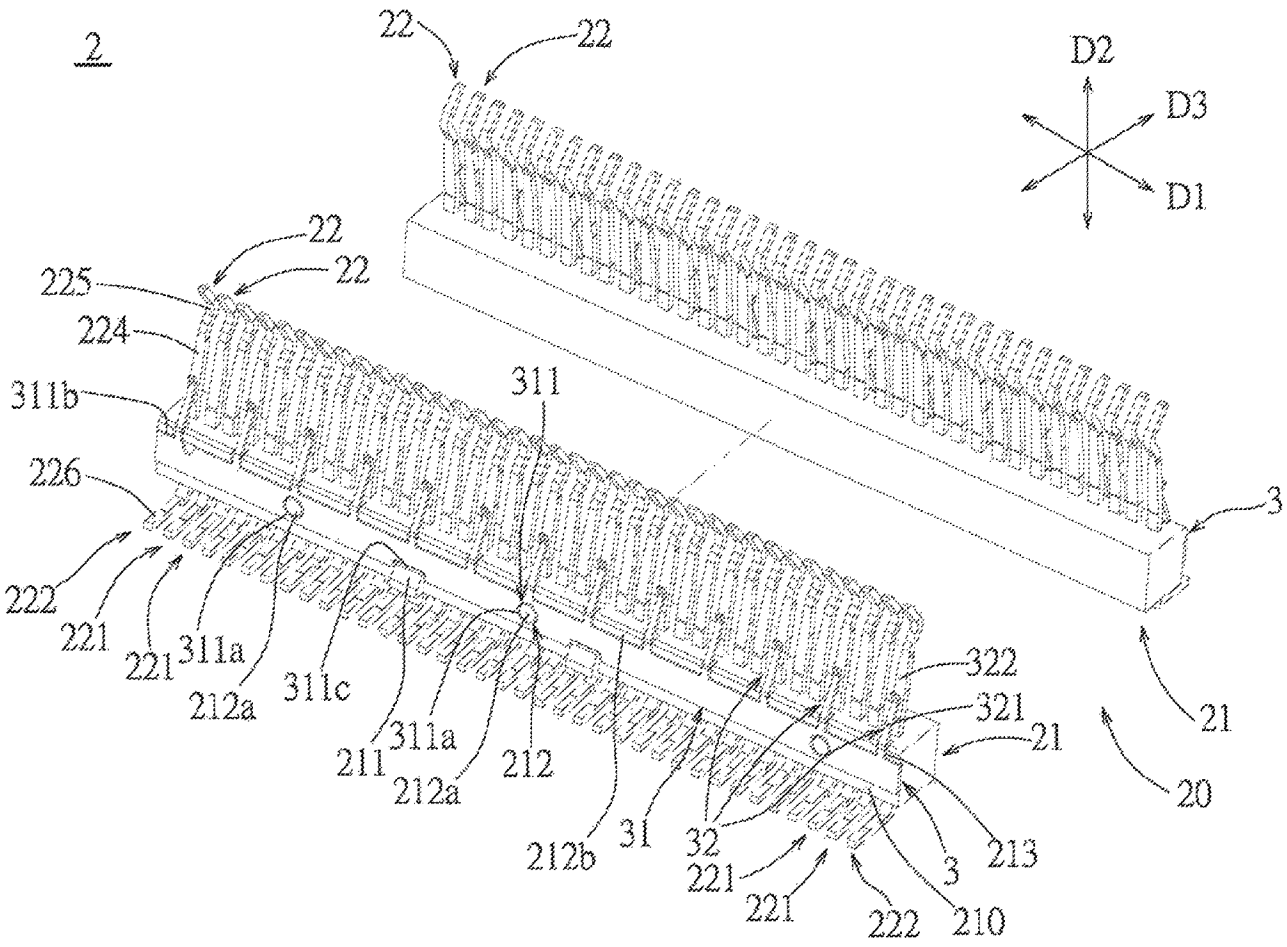
FIG. 6 is a perspective view illustrating one of terminal modules of the embodiment.
Figure 7:
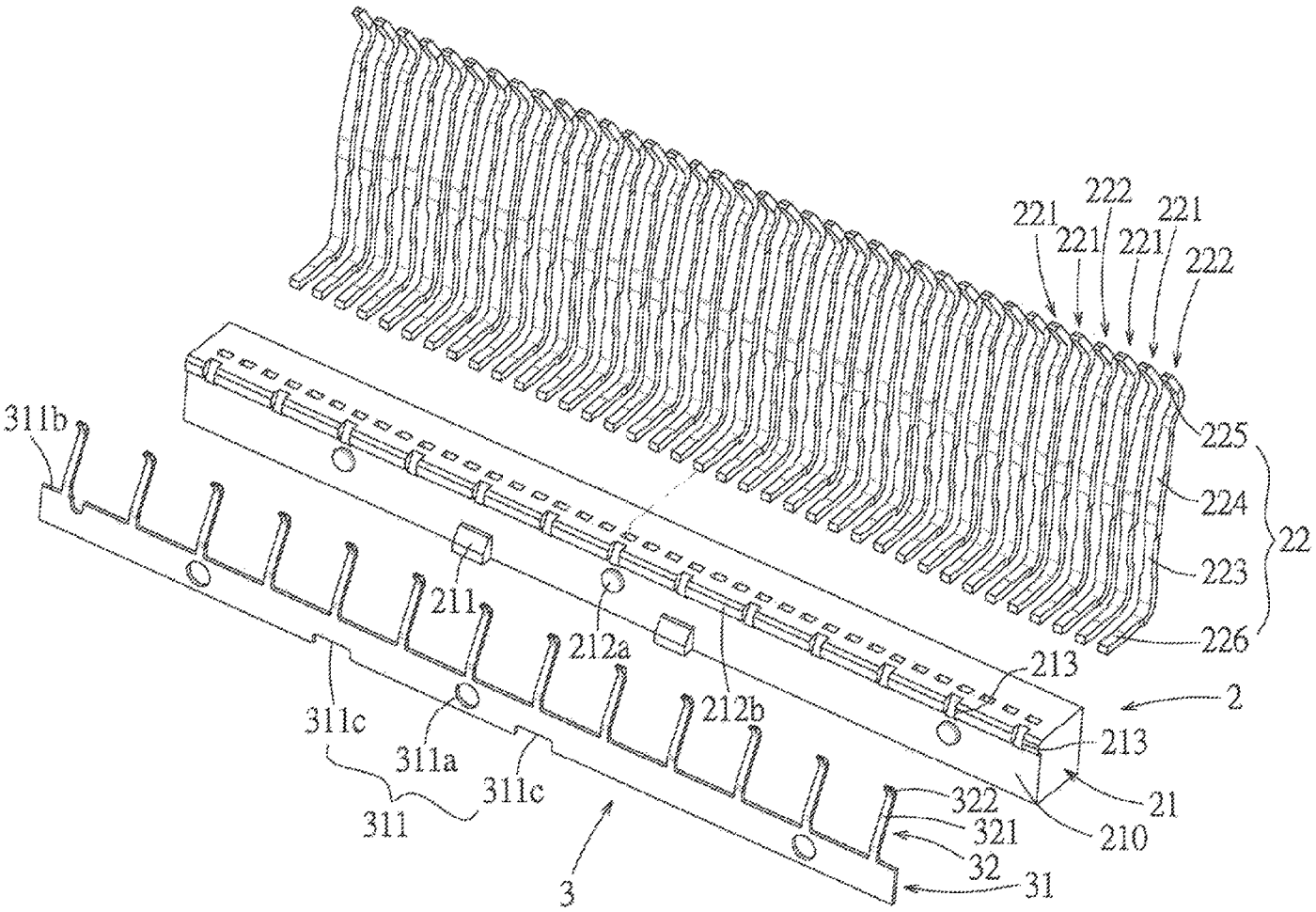
FIG. 7 is an exploded perspective view illustrating a part of the one of the terminal modules.
Figure 8:
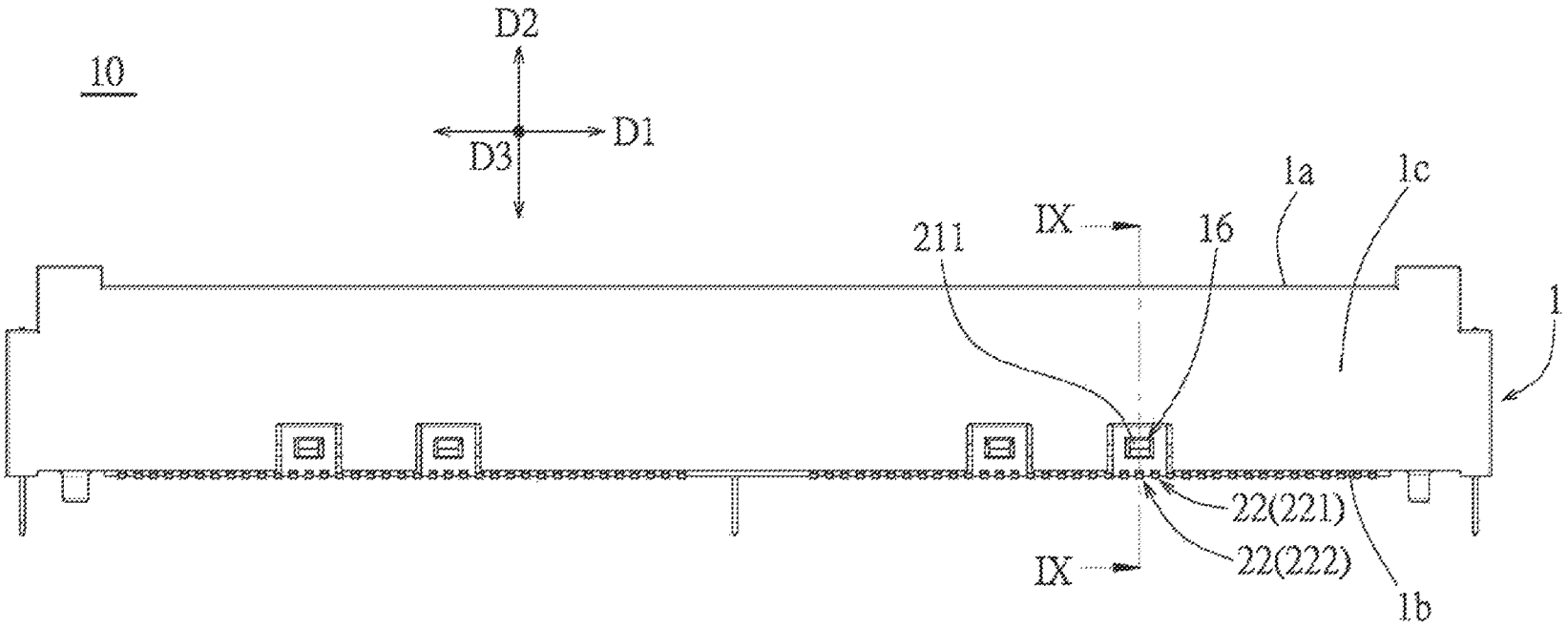
FIG. 8 is a front view of the embodiment.
Figure 9:
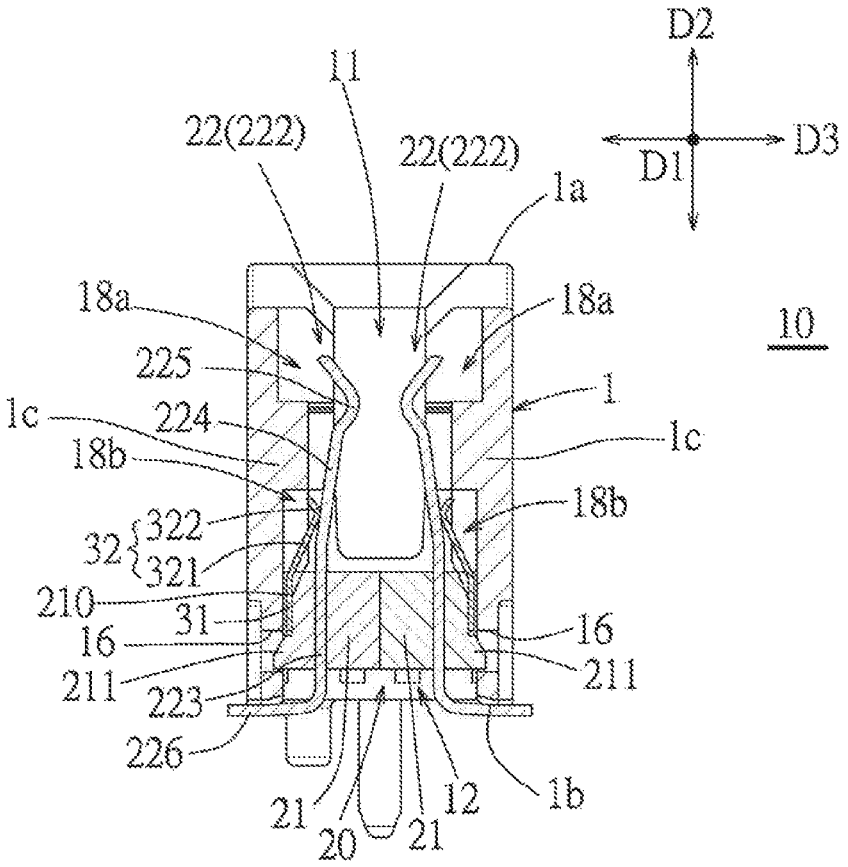
FIG. 9 is a cross-sectional view taken along a line IX-IX of FIG. 8.
Figure 10:
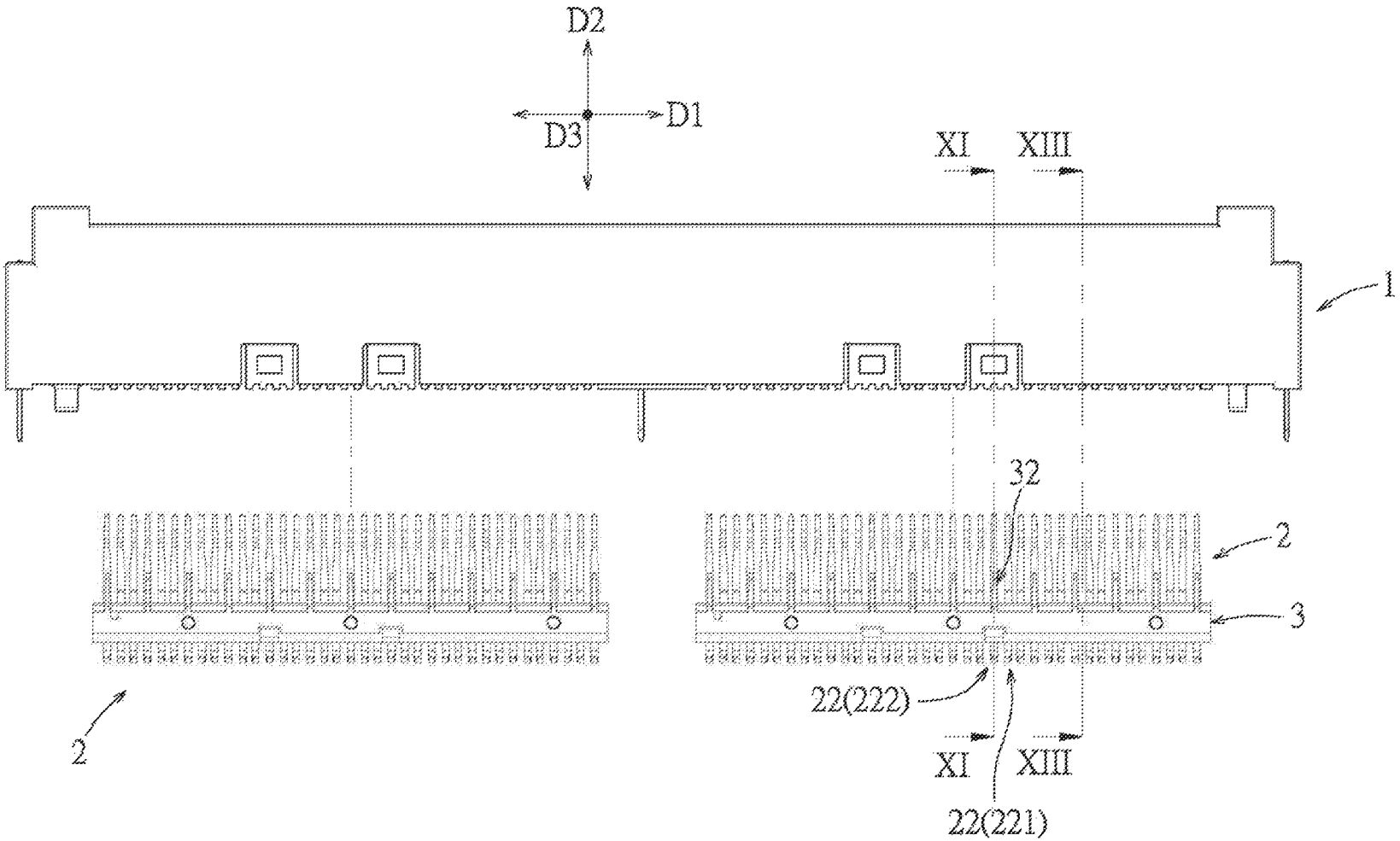
FIG. 10 is a front exploded view of FIG. 8.
Figure 11:
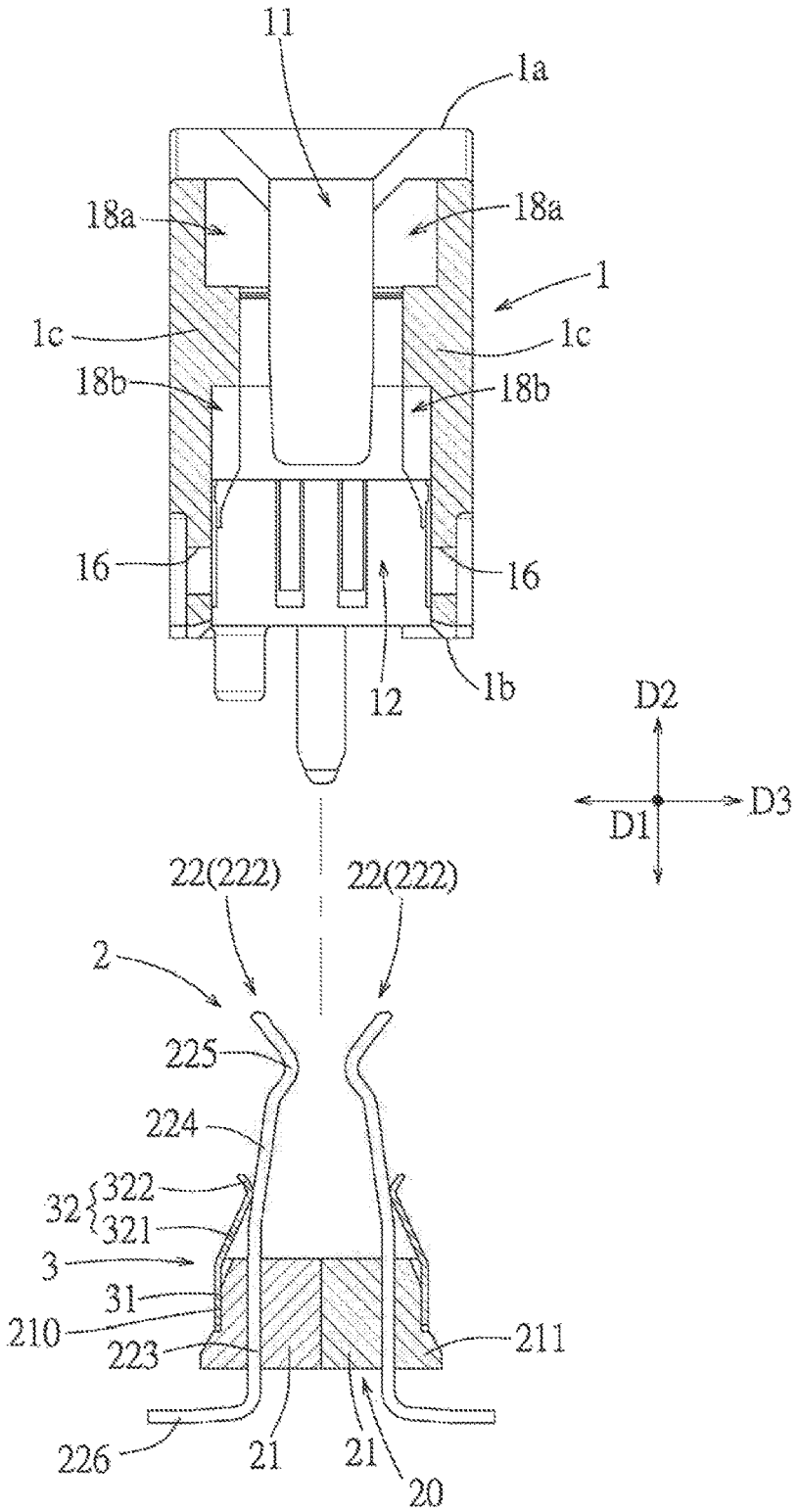
FIG. 11 is a cross-sectional view taken along a line XI-XI of FIG. 10.
Figure 12:
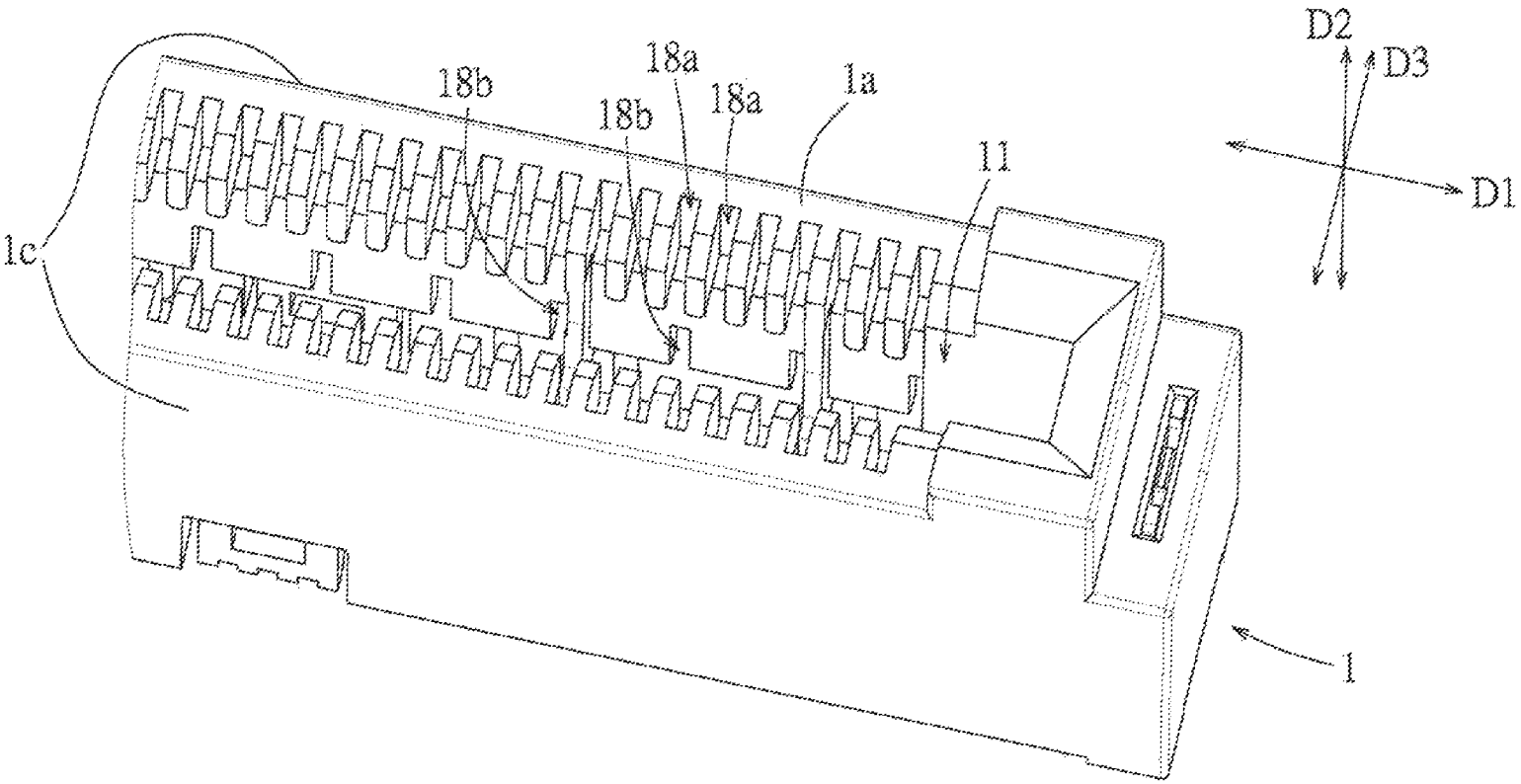
FIG. 12 is a partial enlarged perspective view illustrating a terminal receiving groove and a grounding elastic arm receiving groove of the insulative housing of the embodiment.
Figure 13:
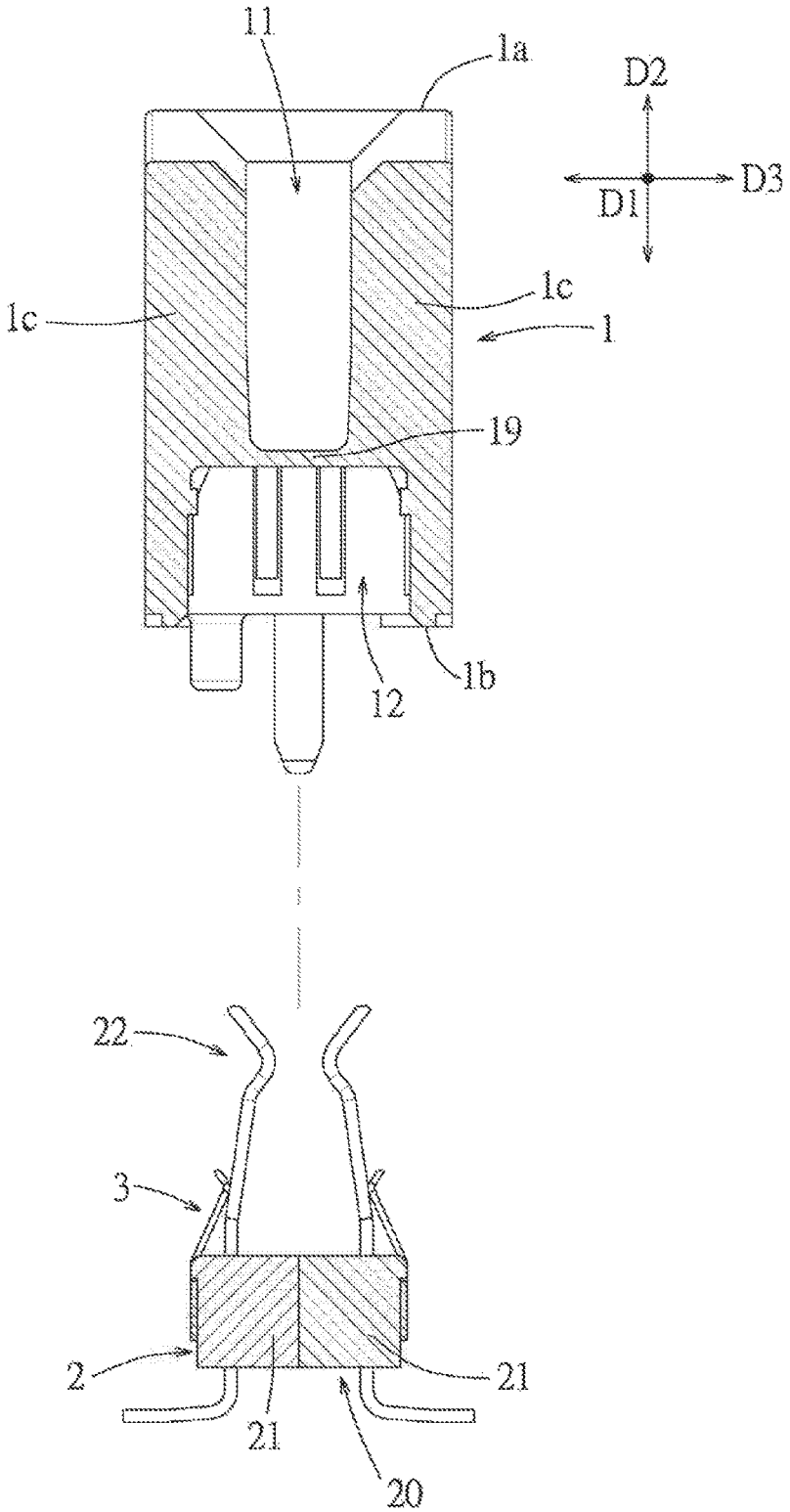
FIG. 13 is a cross-sectional view taken along a line XIII-XIII of FIG. 10.
Figure 14:
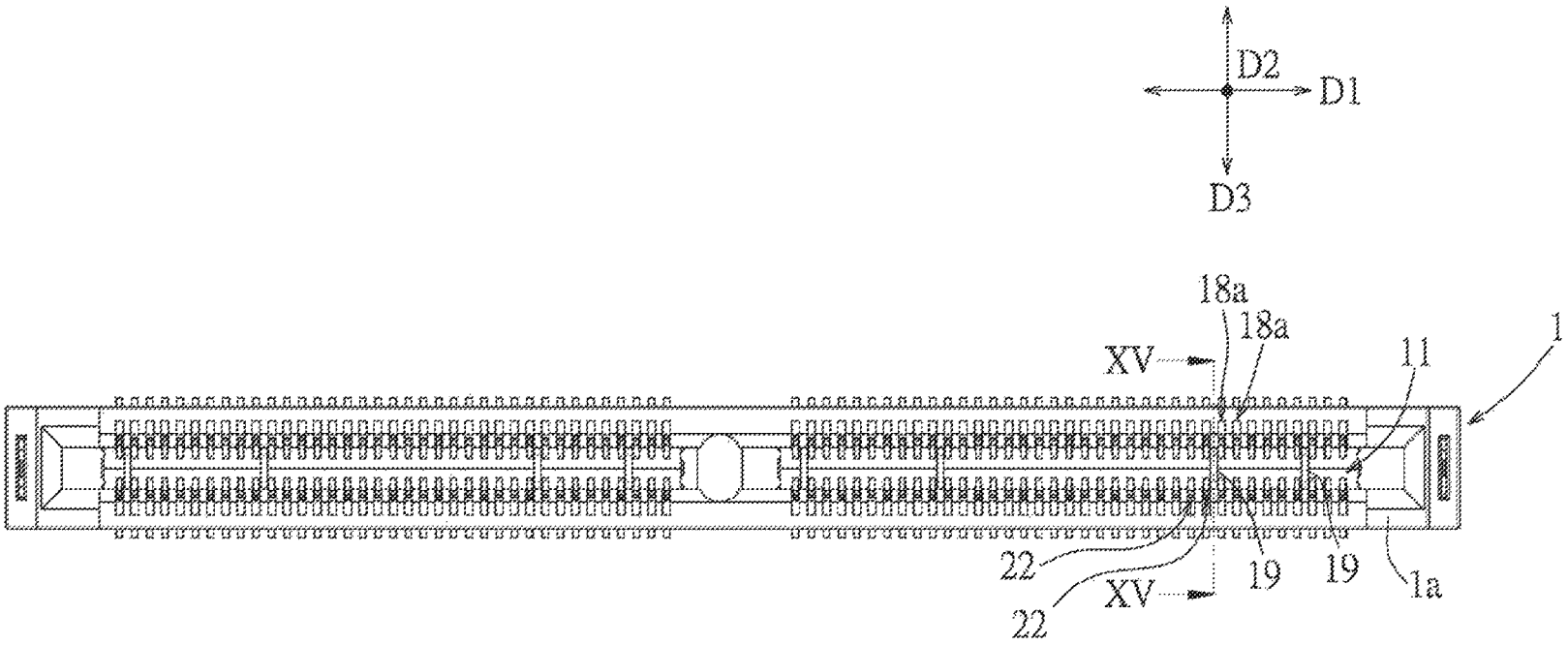
FIG. 14 is a top view of the embodiment.
Figure 15:
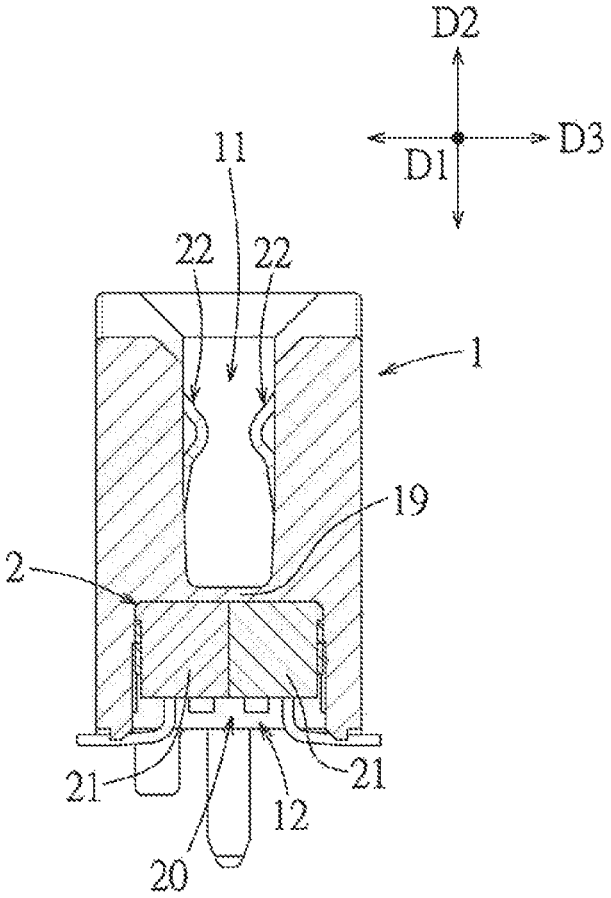
FIG. 15 is a cross-sectional view taken along line a XV-XV of FIG. 14.
Figure 16:
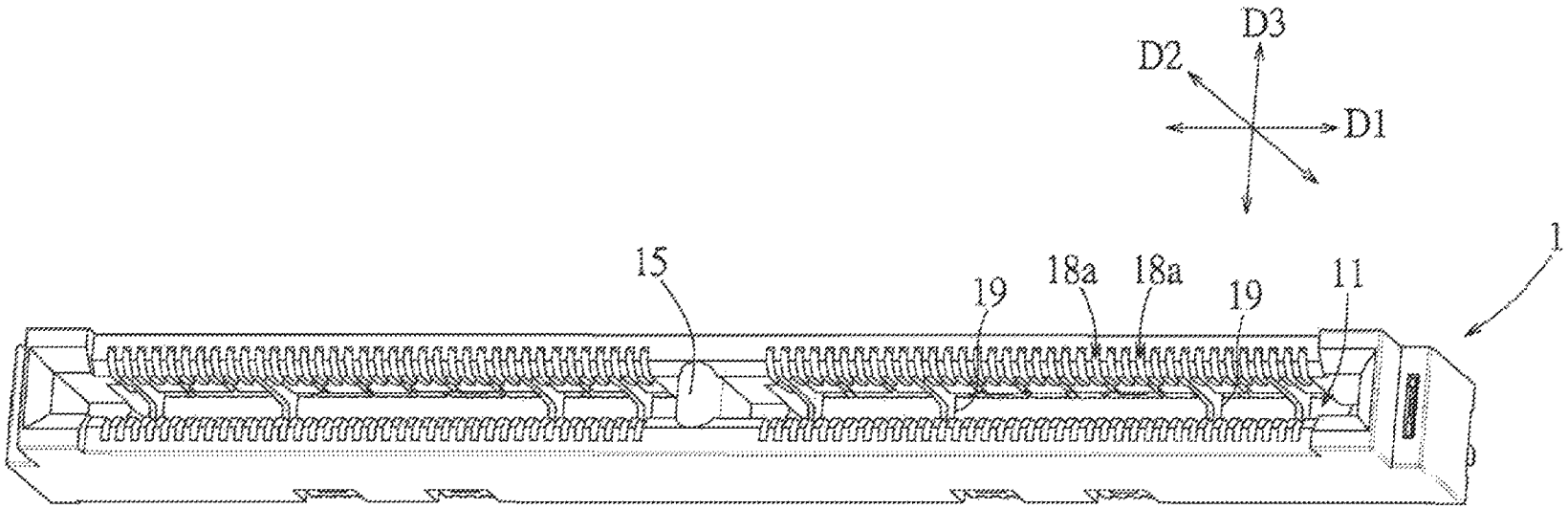
FIG. 16 is a perspective view illustrating the partition rib of the insulative housing of the embodiment.

In combination with referring to FIG. 5, more specifically, the insulative housing 1 of the embodiment further comprises a positioning partition portion 15 extending along a width direction D3 perpendicular to the length direction D1 near a center of the card edge slot 11, and the positioning partition portion 15 extends downwardly to the terminal retention base mounting groove 12 and to be adjacent to the mounting surface 1*b* of the insulative housing 1, the positioning partition portion 15 is used to position the mating object, the positioning partition portion 15 partitions the card edge connector 10 into two card edge slots 11 and two terminal retention base mounting grooves 12, so as to respectively allow the two terminal modules 2 to be mounted; but in other embodiments, the insulative housing 1 may also have no positioning partition portion 15, and is not limited thereto. In addition, in order to be clear in the following description of the embodiments, a part of the description will be described by taking one card edge slot 11, one terminal retention base mounting groove 12 and one terminal module 2 as an example. In addition, in the embodiment, one of the board fixing elements 14 is located at a bottom of the positioning partition portion 15.

Referring to FIG. 6 to FIG. 9, each terminal module 2 comprises a terminal retention base 20 extending along the length direction D1 and mounted in the terminal retention base mounting groove 12 and at least one row of conductive terminals 22 which are spaced apart from each other and fixed to the terminal retention base 20 side by side in the length direction D1. In the embodiment, the terminal module 2 comprises two rows of conductive terminals 22 which face each other and are fixed in the terminal retention base 20, and the terminal retention base 20 has two terminal retainers 21 which are united with each other and mounted in the terminal retention base mounting groove 12, the two rows of conductive terminals 22 are respectively fixed in the terminal retainers 21. In a variant embodiment, the terminal retention base 20 can also be a non-separable structure for fixing the two rows of conductive terminals 22. In another variant embodiment, the terminal module 2 may also have only one row of the conductive terminals 22 fixed in the non-detachable terminal retention base 20, so the terminal module 2 is not limited to the embodiment. In addition, it should be noted that, the conductive terminals 22 of the embodiment is embedded and fixed in the corresponding terminal retainer 21 by insert molding, but is not limited thereto. The plurality of conductive terminals 22 comprises signal terminals 221 and ground terminals 222, and in the embodiment, each row of the conductive terminals 22 is composed of a plurality of signal terminal pairs (each signal terminal pair is composed of two signal terminals 221, for example, forming a differential signal terminal pair) and a plurality of ground terminals 222, and the plurality of signal terminal pairs are alternated with the plurality of ground terminals 222. Each conductive terminal 22 has a fixed portion 223 fixed in the terminal retainer 21 of the terminal retention base 20, an elastic arm portion 224 extending upwardly from the fixed portion 223 to the card edge slot 11, a contact portion 225 extending from a distal end of the elastic arm portion 224 into the card edge slot 11 and used to be mated with the mating object and a tail portion 226 extending downwardly from the fixed portion 223, the tail portion 226 extends to the mounting surface 1*b* of the insulative housing 1 and a distal end of the tail portion 226 bends outwardly, in the embodiment, the tail portion 226 is used to be surface soldered to the circuit board to electrically connect the conductive terminal 22 to the circuit board. In an embodiment, the tail portion 226 can be a through hole-type soldering leg or a needle-eye type pressing fit leg.

Figure 3:
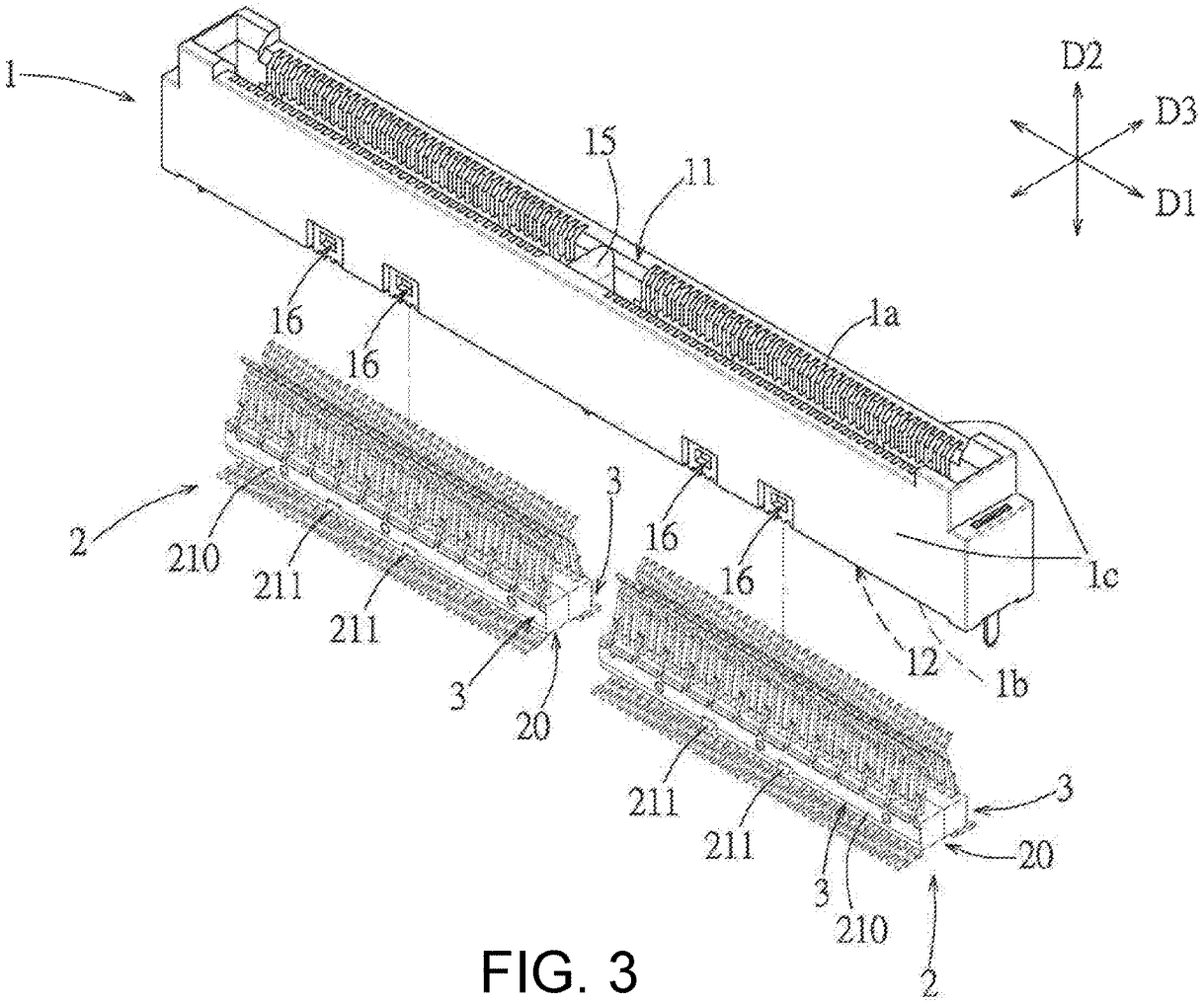
FIG. 3 is an exploded perspective view of FIG. 1.
Figure 4:
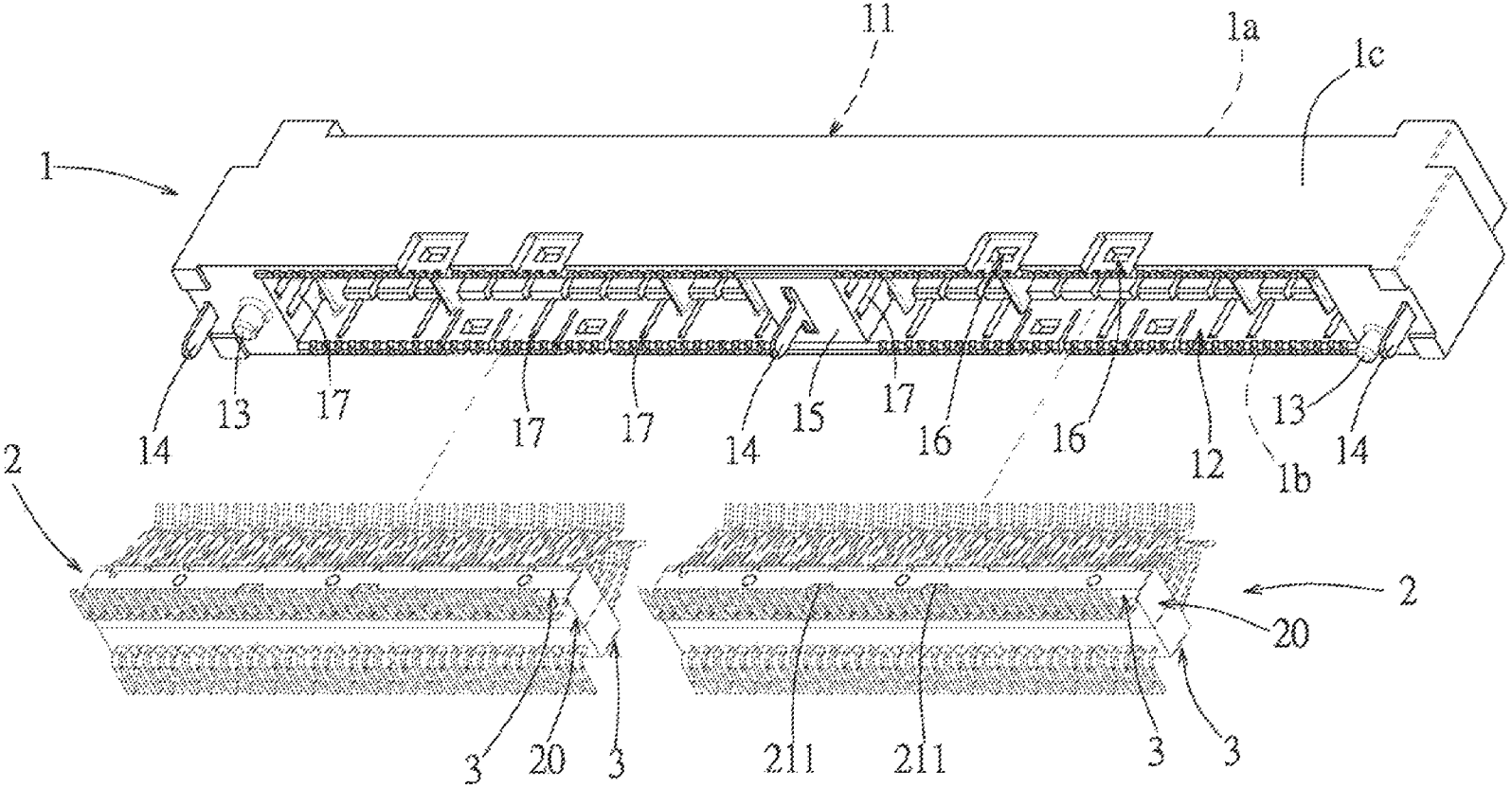
FIG. 4 is an exploded perspective view of FIG. 2.

Referring to FIG. 3 and FIG. 4, in the embodiment, each terminal module 2 is mounted in the terminal retention base mounting groove 12 from an opening of the mounting surface 1*b*, the contact portions 225 of the conductive terminals 22 of the terminal module 2 face upwardly while mounting the terminal module 2, and the two terminal retainers 21 are united with each other and pushed into the terminal retention base mounting groove 12, so that the contact portion 225 of each conductive terminal 22 extends into the card edge slot 11, the two rows of conductive terminals 22 of each terminal module 2 face each other, to respectively contact conductive pads or conductive traces (not shown) on two side surfaces of the mating object in the width direction D3 when the mating object is inserted. In the embodiment, the insulative housing 1 further comprises a plurality of latching holes 16 formed at an inner wall surface defining the terminal retention base mounting groove 12, each terminal retainer 21 of the terminal retention base 20 has an installation surface 210 and two latching blocks 211 located on the installation surface 210, when the terminal module 2 is pushed into the terminal retention base mounting groove 12, the latching block 211 latches with the corresponding latching hole 16, in turn the two terminal retainers 21 of the plurality of terminal modules 2 can be united with each other and fixed to the terminal retention base mounting groove 12, in addition, as will be described in more detail, in the embodiment, the plurality of latching holes 16 are formed in the side wall 1*c* of the insulative housing 1 in a penetrating manner, but are not limited thereto. In addition, referring to FIG. 4 and FIG. 5, in the embodiment, the insulative housing 1 is further formed with a plurality of protruding ribs 17 protruding from the inner wall surface defining the terminal retention base mounting groove 12, the plurality of protruding ribs 17 are squeezed to abut against the terminal retainers 21 of the terminal modules 2, to increase the retention force of the insulative housing 1 to the terminal modules 2, as shown in FIG. 4 and FIG. 5, a plurality of protruding ribs 17 are provided on the four inner wall surfaces defining the terminal retention base mounting groove 12, however, a plurality of protruding ribs 17 may be provided only on the two inner wall surfaces defining the longitudinal direction D1 of the terminal retention base mounting groove 12, and should not be limited to the embodiment.

Referring again to FIG. 6 to FIG. 9, the terminal module 2 further comprises at least one common grounding shield 3, the at least one common grounding shield 3 comprises a sheet 31 extending along the length direction D1 and provided between the corresponding terminal retention base 20 and the side wall 1*c* of the insulative housing 1 and a plurality of grounding elastic arms 32 extending from the sheet 31 toward the mating surface 1*a* and respectively corresponding to the plurality of ground terminals 222 in position. In the embodiment, the terminal module 2 comprises two common grounding shields 3, the two common grounding shields 3 are respectively provided between the terminal retention base 20 and the corresponding two side walls 1*c* of the insulative housing 1, more specifically, the two common grounding shields 3 are respectively provided on the installation surfaces 210 of the corresponding two terminal retainers 21 and each are positioned between the corresponding terminal retainer 21 and the corresponding side wall 1*c* of the insulative housing 1. Each terminal retainer 21 has a first positioning structure 212 formed on the installation surface 210, the sheet 31 of each common grounding shield 3 is formed with a second positioning structure 311 engaged with the first positioning structure 212 to be relatively fixed with the corresponding terminal retainer 21 of the terminal retention base 20. Describing this embodiment in more detail, the first positioning structure 212 comprises three positioning protruding blocks 212*a* which are formed on the installation surface 210 of the terminal retainer 21, arranged and spaced part from each other along the length direction D1, a positioning protruding bar 212*b* which is formed at a top of the installation surface 210 of the terminal retainer 21 and extends along the length direction D1 and the above two latching blocks 211 located on the installation surface 210, the second positioning structure 311 comprises three positioning holes 311*a* which are formed on the sheet 31 corresponding to the positioning protruding block 212*a* and are engaged with the positioning protruding blocks 212*a*, a positioning surface 311*b* positioned at a top of the sheet 31 and limited by the positioning protruding bar 212*b* and two cutouts 311*c* formed at a bottom of the sheet 31 and correspondingly engaged with the latching blocks 211. In addition, each terminal retainer 21 is further formed with a plurality of recessed channels 213 respectively which allow the plurality of the grounding elastic arms 32 to pass through at the positioning protruding bar 212*b*. With the above structures, each common grounding shield 3 can be positioned on the terminal retainer 21 of the corresponding terminal module 2, so as to strengthen limit the plurality of the grounding elastic arm 32 in position and allow the grounding elastic arms to correspond to the position of the plurality of ground terminals 222. In addition, it should be noted that, in the embodiment, the common grounding shields 3 are positioned on the installation surface 210 before the terminal module 2 enters into the terminal retention base mounting groove 12 of the insulative housing 1, so as to allow each common grounding shield 3 to engage with the first positioning structure 212 of the terminal retainer 21 by the second positioning structure 311 on the sheet 31, and after the terminal retention base 20 of the terminal module 2 is inserted into the terminal retention base mounting groove 12, the sheet 31 is clamped between the installation surface 210 of the corresponding terminal retainer 21 and the corresponding side wall 1*c* of the insulative housing 1 and is fixed, but in other embodiments, the sheet 31 of the common grounding shield 3 may be directly fixedly provided on the installation surface 210 of the corresponding terminal retainer 21 via other connection methods, and is not limited thereto. It is to be noted that the plurality of protruding ribs 17 (see FIG. 5) of the insulative housing 1 are used to forcibly abut against the terminal retainers 21 of the plurality of terminal modules 2 at both ends in the length direction D1, and are also used to forcibly abut against the sheets 31 of the common grounding shields 3 at two sides relative to the length direction D1, to simultaneously strengthen the retention force of the insulative housing 1 to the plurality of terminal modules 2 and the plurality of common grounding shields 3.

Each grounding elastic arm 32 has an elastic portion 321 extending upwardly from the sheet 31 and an abutting portion 322 extending upwardly from the elastic portion 321, the abutting portion 322 elastically abuts against a facing outer side surface of the elastic arm portion 224 of the corresponding ground terminal 222 facing the corresponding side wall 1*c*, by the common grounding shield 3 abutting against the plurality of ground terminals 222, the grounding characteristics of the card edge connector 10 can be strengthened, so as to create a shielding function between the signal terminals 221, more specifically, the sheet 31 of the common grounding shield 3 is used to create a substantial shielding effect, and the common grounding shield 3 can create a virtual shielding effect between the adjacent grounding elastic arms 32, so that the crosstalk between the signal terminals 221 is reduced, and, because the mating object is inserted into the card edge slot 11, the mating object will push away the contact portions 225 of the plurality of conductive terminals 22 and make the elastic arm portions 224 of the plurality of conductive terminals 22 to be deformed to move toward the corresponding side wall 1*c*, therefore, by that each grounding elastic arm 32 of the common grounding shield 3 elastically abuts against the facing outer side surface of the elastic arm portion 224 of the corresponding ground terminal 222, the normal contact force between the ground terminals 222 and the mating object and the contact force between the ground terminals 222 and the grounding elastic arms 32 can be increased when the mating object is inserted into the card edge connector 10, in turn, the ground terminals 222, the grounding elastic arms 32 and the mating object can contact reliably and firmly to ensure that the shielding effect of the common grounding shield 3 can be continuously maintained in a stable state, thereby improving the crosstalk.

Referring again to FIG. 9 to FIG. 12, in addition, in the embodiment, the insulative housing 1 is further formed with a plurality of terminal receiving grooves 18*a* which respectively receive the plurality of conductive terminals 22 and a plurality of the grounding elastic arm receiving groove 18*b* which respectively receive the plurality of the grounding elastic arms 32 at the inner wall surface defining the card edge slot 11, the plurality of terminal receiving grooves 18*a* and the plurality of grounding elastic arm receiving groove 18*b* are formed substantially in the width direction D3, the plurality of terminal receiving grooves 18*a* and the plurality of grounding elastic arm receiving grooves 18*b* can respectively allow the plurality of conductive terminals 22 and the plurality of the grounding elastic arms 32 to deflect elastically along the width direction D3, to ensure that each conductive terminal 22 can be electrically connected to the corresponding contact point of the mating object, and ensure that each grounding elastic arm 32 contacts the corresponding ground terminal 222.

Referring to FIGS. 13 to 16, furthermore, in the embodiment, the insulative housing 1 further comprises a plurality of partition ribs 19 positioned in the card edge slot 11 adjacent to the terminal retention base mounting groove 12 and spaced apart from each other and arranged side by side along the length direction D1, the plurality of partition ribs 19 are used to limit the insertion depth of the mating object. In the embodiment, each partition rib 19 has a U-shape with an opening facing upwardly, and a width at the opening facing upwardly thereof can be used to strengthen limiting the position of the mating object in the width direction D3. In addition, in the embodiment, the bottom of the plurality of partition ribs 19 allows the terminal retention base 20 of corresponding terminal module 2 to abut against, so as to strengthen the insulative housing 1 to limit the plurality of terminal modules 2 in position, but in other embodiments, the insulative housing 1 can also limit the terminal retention base 20 of the terminal modules 2 in position only by the step between the card edge slot 11 and the terminal retention base mounting groove 12.

In conclusion, by that the common grounding shield 3 abuts against and connects to the plurality of ground terminals 222, the card edge connector 10 of the present disclosure strengthens the grounding characteristic to create the shielding effect between the signal terminals 221, and, by that each grounding elastic arm 32 of the common grounding shield 3 elastically abuts against the facing outer side surface of the elastic arm portion 224 of the corresponding ground terminal 222, the normal contact force between the ground terminal 222 and the mating object and the contact force between the ground terminal 222 and the grounding elastic arm 32 can be increased when the mating object is inserted into the card edge connector 10, in turn, the ground terminals 222, the grounding elastic arms 32 and the mating object can contact can contact reliably and firmly to ensure that the shielding effect of the common grounding shield 3 can be continuously maintained in a stable state, thereby improving the crosstalk, so that the object of the present disclosure can be achieved.

However, the above description is only for the embodiments of the present disclosure, and the implementing scope of the present disclosure is not limited thereto, and all the simple equivalent changes and modifications according to the scope of the claims and the specification of the present disclosure are still fallen within the scope of the present disclosure.

What is claimed is:

1. A card edge connector, comprising:

an insulative housing having an elongated shape extending along a length direction, the insulative housing comprising a mating surface and a mounting surface on opposite sides, a card edge slot open to the mating surface and a terminal retention base mounting groove open to the mounting surface and communicating with the card edge slot, the insulative housing further comprising two side walls extending along the length direction to together define the card edge slot and the terminal retention base mounting groove;

at least one terminal module comprising a terminal retention base extending along the length direction and mounted in the terminal retention base mounting groove and at least one row of conductive terminals which are spaced apart from each other and fixed to the terminal retention base side by side along the length direction, the plurality of the conductive terminals comprising signal terminals and ground terminals, each conductive terminal having a fixed portion fixed in the terminal retention base, an elastic arm portion extending upwardly from the fixed portion to the card edge slot, a contact portion extending from a distal end of the elastic arm portion into the card edge slot and a tail portion extending out of the mounting surface of the insulative housing from the fixed portion, wherein, the terminal module further comprises at least one common grounding shield, the common grounding shield comprises a sheet extending along the length direction and provided between the terminal retention base and the side wall of the insulative housing and a plurality of the grounding elastic arms extending from the sheet toward the mating surface and respectively corresponding to the plurality of ground terminals in position, each grounding elastic arm has an elastic portion extending upwardly from the sheet and an abutting portion extending upwardly from the elastic portion, the abutting portion elastically abuts against a facing outer side surface of the elastic arm portion of the corresponding ground terminal facing the corresponding side wall.

2. The card edge connector of claim 1, wherein the terminal module comprises two rows of conductive terminals which face each other and are fixed in the terminal retention base and two common grounding shields, the sheets of the common grounding shields are respectively provided between the terminal retention base and the corresponding side walls of the insulative housing.

3. The card edge connector of the claim 2, wherein the terminal retention base has two terminal retainers which are united with each other and mounted in the terminal retention base mounting groove, the two rows of conductive terminals are respectively fixed in the terminal retainers, the common grounding shields are respectively provided on the corresponding terminal retainers and each are respectively positioned between the corresponding terminal retainer and the side wall of the insulative housing.

4. The card edge connector of claim 3, wherein each row of the conductive terminals is composed of a plurality of signal terminal pairs and a plurality of ground terminals, the plurality of the signal terminal pairs are alternated with the plurality of ground terminals.

5. The card edge connector of claim 1, wherein the terminal retention base has an installation surface to allow the sheet of the common grounding shield to be provided thereon and a first positioning structure formed on the installation surface, the sheet of each common grounding shield is formed with a second positioning structure engaged with the first positioning structure to be relatively fixed with the terminal retention base.

6. The card edge connector of claim 5, wherein the first positioning structure comprises at least one positioning protruding block, the second positioning structure comprises at least one positioning hole which is engaged with the positioning protruding block.

7. The card edge connector of claim 5, wherein the first positioning structure comprises a positioning protruding bar which is formed at a top of the installation surface of the terminal retention base and extends along the length direction, the second positioning structure comprises a positioning surface positioned at a top of the sheet and engaged with the positioning protruding bar, the terminal retention base is further formed with a plurality of recessed channels which respectively allow the plurality of the grounding elastic arms to pass through at the positioning protruding bar.

8. The card edge connector of claim 6, wherein the first positioning structure further comprises at least one latching block formed on the mounting surface, the second positioning structure further comprises at least one cutout engaged with the at least one latching block, the insulative housing has at least one latching hole formed at an inner wall surface defining the terminal retention base mounting groove and latching with the at least one latching block of the terminal retention base.

9. The card edge connector of claim 1, wherein the insulative housing is further formed with a plurality of protruding ribs protruding from an inner wall surface defining the terminal retention base mounting groove, the plurality of protruding ribs are used to forcibly abut against the terminal retention base of the at least one terminal module and the at least one common grounding shield.

10. The card edge connector of claim 1, wherein the insulative housing comprises a plurality of partition ribs positioned in the card edge slot adjacent to the terminal retention base mounting groove and spaced apart from each other and arranged side by side along the length direction.

11. The card edge connector of claim 1, wherein the insulative housing is further formed with a plurality of terminal receiving grooves which respectively receive the plurality of conductive terminals and a plurality of the grounding elastic arm receiving grooves which respectively receive the plurality of the grounding elastic arms at an inner wall surface defining the card edge slot.

* * * * *